US007111422B2

(12) United States Patent
Wheeler

(10) Patent No.: US 7,111,422 B2
(45) Date of Patent: Sep. 26, 2006

(54) HANGTAG FOR MULTIPLE TOOLS

(75) Inventor: Thomas J. Wheeler, Pomona, CA (US)

(73) Assignee: JPJ Investment Holding Corp., Las Vegas, NV (US)

( * ) Notice: Subject to any disclaimer, the term of this patent is extended or adjusted under 35 U.S.C. 154(b) by 36 days.

(21) Appl. No.: 10/834,568

(22) Filed: Apr. 29, 2004

(65) Prior Publication Data

US 2005/0005485 A1 Jan. 13, 2005

Related U.S. Application Data

(60) Provisional application No. 60/466,253, filed on Apr. 29, 2003.

(51) Int. Cl.
*B65D 73/00* (2006.01)

(52) U.S. Cl. ..... 40/617; 206/378; 211/70.6; 40/673

(58) Field of Classification Search ..... 206/349, 206/378, 806; 40/617, 673; 211/70.6
See application file for complete search history.

(56) References Cited

U.S. PATENT DOCUMENTS

| | | | | |
|---|---|---|---|---|
| 3,354,915 | A | 11/1967 | Johnson | |
| 3,568,853 | A * | 3/1971 | Feibelman | 211/113 |
| D227,229 | S | 6/1973 | Funahashi | |
| D249,639 | S | 9/1978 | Hogg et al. | |
| D282,118 | S | 1/1986 | Mengwasser | |
| D297,651 | S | 9/1988 | Merl | |
| 4,944,389 | A * | 7/1990 | Robertson | 206/6.1 |
| D314,984 | S | 2/1991 | Hass | |
| 5,044,591 | A * | 9/1991 | Huang | 248/317 |
| D327,507 | S | 6/1992 | Wahl | |
| 5,129,617 | A | 7/1992 | MacWilliamson | |
| D370,174 | S | 5/1996 | Bergstedt | |
| D374,462 | S | 10/1996 | Tyler | |
| 5,728,440 | A | 3/1998 | Good | |
| 5,785,174 | A | 7/1998 | Chow | |
| 5,975,297 | A * | 11/1999 | Kao | 206/378 |
| 6,032,797 | A | 3/2000 | Kao | |
| 6,036,064 | A | 3/2000 | Tawil | |
| 6,102,199 | A | 8/2000 | Ho | |
| 6,197,396 | B1 | 3/2001 | Haas | |
| 6,267,152 | B1 | 7/2001 | Doerr | |
| 6,273,255 | B1 | 8/2001 | Rosler | |
| 6,378,700 | B1 | 4/2002 | Tong | |
| 6,409,015 | B1 | 6/2002 | Hu | |

(Continued)

OTHER PUBLICATIONS

U.S. Appl. No. 29/183,299 (OLYM/0082), filed Jun. 10, 2003, Thomas J. Wheeler, et al., "Hangtag."

(Continued)

*Primary Examiner*—Cassandra Davis
(74) *Attorney, Agent, or Firm*—Patterson & Sheridan. L.L.P.

(57) ABSTRACT

A hangtag is provided that is capable of hanging multiple tools. The hangtag has a body portion, a hanging mechanism connected to the body portion, and a tool supporting mechanism also connected to the body portion for supporting a tool. The body portion has a front surface and a back surface. On the back surface is disposed a hangtag attachment apparatus. The hangtag attachment apparatus comprises a bracket, and an elongated attachment bar configured to be selectively attached to and detached from the bracket. The attachment bar has a length that permits it to be connected to at least two and preferably more hangtags so that multiple hangtags may be selectively connected together. In this way, tools that would otherwise be sold individually can now be sold as a set.

8 Claims, 6 Drawing Sheets

U.S. PATENT DOCUMENTS

| | | | | |
|---|---|---|---|---|
| 6,425,482 | B1 | 7/2002 | Chiang | |
| 6,536,611 | B1 | 3/2003 | Chen | |
| 6,581,894 | B1 | 6/2003 | Tong | |
| 6,634,501 | B1 | 10/2003 | Su | |
| 6,672,555 | B1 | 1/2004 | Chang | |
| 2003/0029756 | A1 | 2/2003 | Vasudeva | |
| 2003/0070949 | A1 | 4/2003 | Harris et al. | |
| 2004/0031710 | A1* | 2/2004 | Esme | 206/378 |

OTHER PUBLICATIONS

U.S. Appl. No. 29/199,555 (OLYM/0082.D1), filed Feb. 17, 2004, Thomas J. Wheeler, et al., "Hangtag."

U.S. Appl. No. 10/458,065 (OLYM/0092), filed Jun. 10, 2003, Thomas J. Wheeler, "Hangtag With Tool Securing Mechanism."

U.S. Appl. No. 10/463,205 (OLYM/0091), filed Jun. 17, 2003, Thomas J. Wheeler, et al., "Tool Securing Mechanism For Hangtag Assembly."

U.S. Appl. No. 10/806,027 (OLYM/0091.P1), filed Mar. 22, 2004, Thomas J. Wheeler, et al., "Tool Securing Mechanism For Hangtag Assembly."

"Source Tagging Solutions Come From Partnership," Technology News for Loss Prevention and Supply Chain Management Retail News, (Retail News is a publication of Checkpoint Sytems, Inc.), vol. 2, 2001, pp. 1-8.

* cited by examiner

HANGTAG FOR MULTIPLE TOOLS

CROSS-REFERENCE TO RELATED APPLICATIONS

This application claims benefit of U.S. provisional patent application Ser. No. 60/466,253, filed Apr. 29, 2003, which is herein incorporated by reference.

BACKGROUND OF THE INVENTION

1. Field of the Invention

The present invention generally relates to tools and tool accessories. The invention more particularly relates to hang tags for supporting and displaying tools. Still further, the invention pertains to a hangtag mechanism for supporting and displaying multiple tools.

2. Description of the Related Art

In the tool industry, it is desirable to display tools in an organized and presentable manner. One way in which this has been done is through the use of hangtags. Hangtags allow individual tools to be supported and displayed.

FIG. 1 presents a hangtag 50 recently developed by Olympia Group, Inc. The hangtag 50 first comprises a main body 54. The body 54 is generally planar, but optionally includes an upper concave portion 55 for displaying a first label. Typically, the first label will present the house mark under which the tool product is sold. The body 54 may optionally also include a lower concave portion 56. The lower concave portion allows a label describing the product 10 itself to be affixed in an ornamental and pleasing manner.

In the exemplary hangtag 50 of FIG. 1, the product 10 is a socket. The socket 10 is supported by a tool supporting mechanism 20. The tool supporting mechanism 20 allows the tool 10 to be securely held to the hangtag 50 in a retail environment, but to be detached from the hangtag 50 once the tool 10 has been purchased by a customer.

At the top of the body 54, a hanging mechanism 52 is provided. The hanging mechanism 52 includes a through-opening 53 for receiving a hook (not shown). The hook, in turn, would be attached to a display panel (also not shown). In practice, a number of hooks are disposed along a display panel, permitting various hangtags 50 supporting various products 10 to be presented to the customer in a retail environment.

In many instances, it is desirable to sell tools as a set. Examples include socket sets and nut driver sets. In this respect, a series of sockets or a series of nut drivers are provided, capable of driving nuts of different sizes. However, when these tools are displayed through a hangtag arrangement, such as the hangtag 50 of FIG. 1, it has heretofore been impossible to sell tools as a true set, with a single price and a single product bar code.

Therefore, a hangtag arrangement is needed for displaying multiple tools as a set. Further, a hangtag arrangement is needed that allows the seller to selectively attach individual hangtags to form a set.

SUMMARY OF THE INVENTION

The present invention provides a hangtag for displaying multiple tools. According to the present invention, individual hangtags, such as the exemplary hangtag shown in FIG. 1, may be attached together to selectively form a set.

The hangtag first comprises a body portion. The body portion has a front surface and a back surface. The hangtag has a tool supporting mechanism attached to the body portion. The tool supporting mechanism serves to support a tool. A hanging mechanism is provided. Typically, the hanging mechanism is attached at the top of the body portion of the hangtag.

A hangtag attachment apparatus is provided with the hangtag. The hangtag attachment apparatus comprises a bracket on the back surface of the hangtags. Each hangtag has a substantially identical bracket arrangement. The brackets receive an elongated attachment bar. The attachment bar is of sufficient length to travel through the brackets of at least two hangtags. The attachment bar is fabricated from a material of sufficient strength as to rigidly support the hangtags, allowing the hangtags to be displayed on a display panel together as a set.

BRIEF DESCRIPTION OF THE DRAWINGS

So that the manner in which the above recited features of the present invention can be understood in detail, a more particular description of the invention, briefly summarized above, may be had by reference to the appended drawings (FIGS. 2–10). It is to be noted, however, that the appended drawings illustrate only typical embodiments of this invention and are therefore not to be considered limiting of its scope.

DETAILED DESCRIPTION OF THE PREFERRED EMBODIMENT

Figure 1:
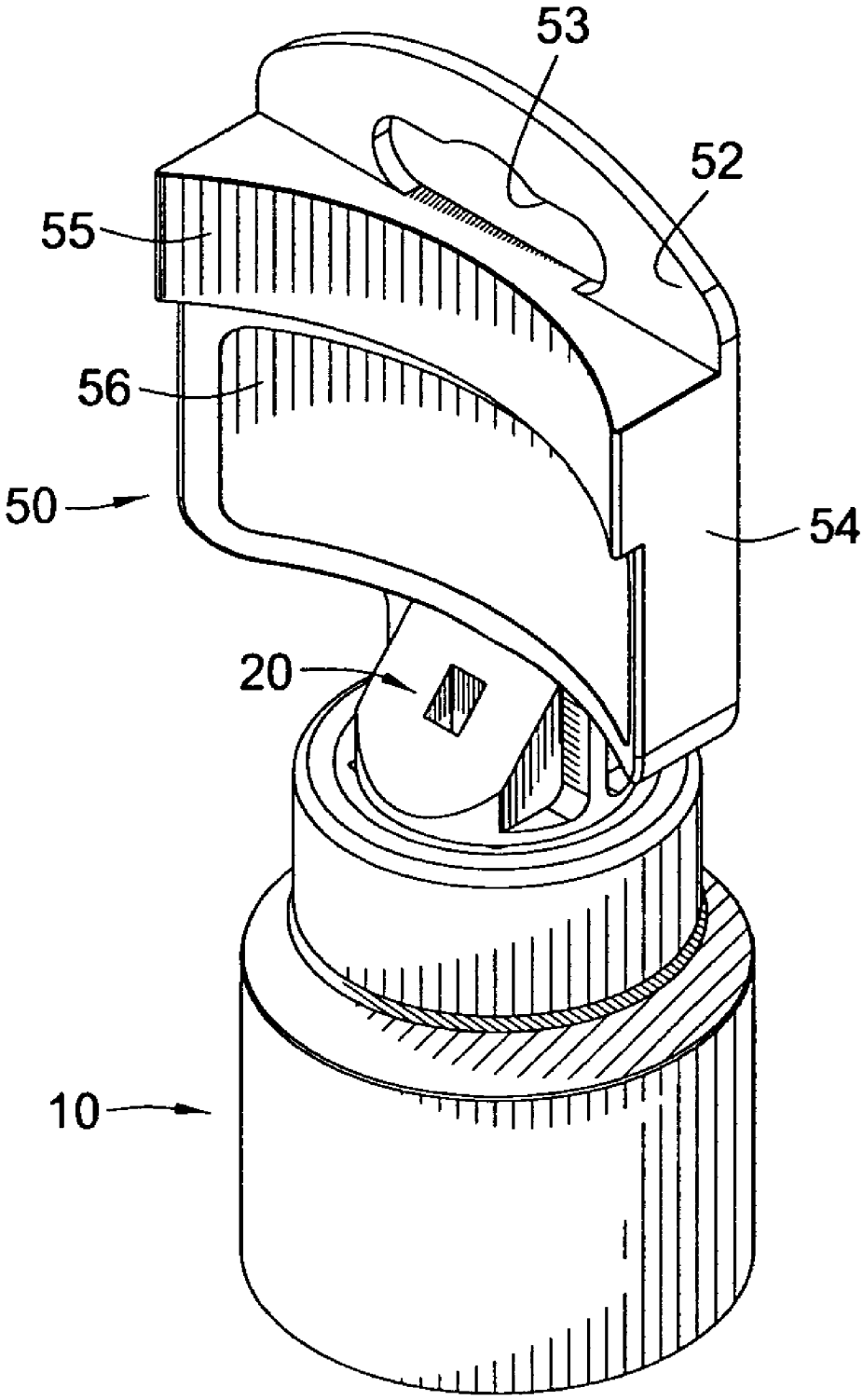
FIG. 1 presents a perspective frontal view of a hangtag as might be used to support and display a single tool product. In the view of FIG. 1, the hangtag is supporting a socket.

The present invention provides a hangtag 50 having an attachment apparatus 100/110 for displaying multiple tools. The hangtag attachment apparatus 100/110 will permit multiple hangtags such as the exemplary hangtag 50 shown in FIG. 1, to be selectively attached to form a set 50*s*.

Figure 2:
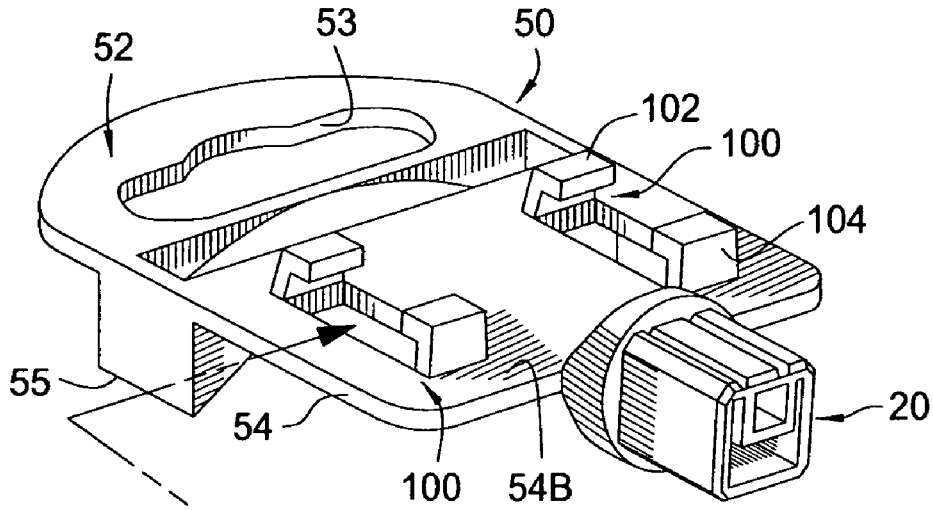
FIG. 2 provides a perspective rear view of a hangtag of the present invention, in a first embodiment. The back surface of the body portion of the hangtag is visible. The back surface includes a bracket for receiving an elongated attachment bar. A mating attachment bar is seen exploded away from the hangtag.

FIG. 2 provides a perspective view of a hangtag 50 of the present invention, in a first embodiment. The hangtag 50 first comprises a body portion 54. The body portion 54 has a front surface and a back surface 54*b*. In the view of FIG. 2, the back surface of the body portion 54 is visible. The back surface 54*b* includes a bracket 100. In the arrangement of FIG. 2, the bracket 100 is comprised of upper 102 and lower 104 shoulder members. The bracket 100 is configured to receive a mating attachment bar 110. The mating attachment bar 110 is seen exploded away from the hangtag 50 in FIG. 2. Together, the bracket 100 and the attachment bar 110 form a hangtag attachment apparatus 100/110.

Figure 3:
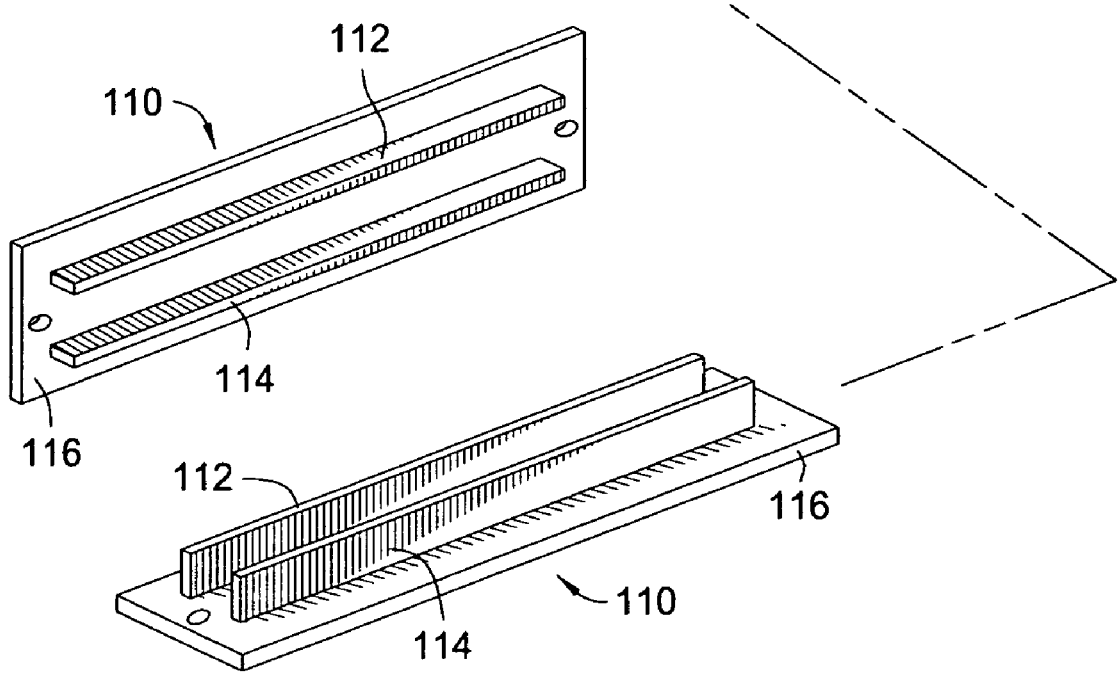
FIG. 3 shows the attachment bar of FIG. 2, in an isometric view.

FIG. 3 shows the attachment bar 110 of FIG. 2 in an isometric view. The attachment bar 110 defines an elongated bar dimensioned to be received within brackets 100 of at least two hangtags 50. In the arrangement of FIGS. 2 and 3, the attachment bar 110 is substantially planar. However, any geometry may be used so long as the attachment bar 110 can be fixedly received within the brackets 100 of the hangtags 50.

It can be seen in both FIGS. 2 and 3 that the attachment bar 110 has upper 112 and lower 114 guide rails. The guide rails 112 and 114 are supported on a base 116. The base 116 is dimensioned to be received within the bracket 100 under the upper 102 and lower 104 shoulder members. The guide rails 112 and 114, in turn, are received between the 102 and lower 104 shoulder members. It is understood that a single guide rail having a larger width (not shown) could be used, rather than the two separate and spaced apart guide rails 112, 114 shown in FIG. 3.

Figure 4:
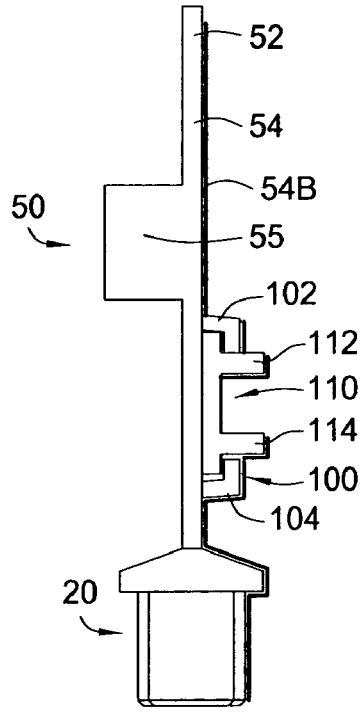
FIG. 4 presents the hangtag of FIG. 2 in a side view. The attachment bar is shown mated with the bracket to form a hangtag attachment apparatus.

FIG. 4 presents the hangtag 50 of FIG. 2 in a side view. The attachment bar 110 is shown received within the bracket 100 on the back surface 54*b* of the hangtag 50. In this manner, a hangtag attachment apparatus 100/110 is formed.

The hangtag 50 of FIG. 2 has a tool supporting mechanism 20 attached to the body portion 54. The tool supporting mechanism 20 serves to support a tool, such as the socket 10 in FIG. 1. It is understood that the present invention is not limited by the type of tool supporting mechanism 20 used, or the type of tool attached to the hangtag 50.

Figure 5:
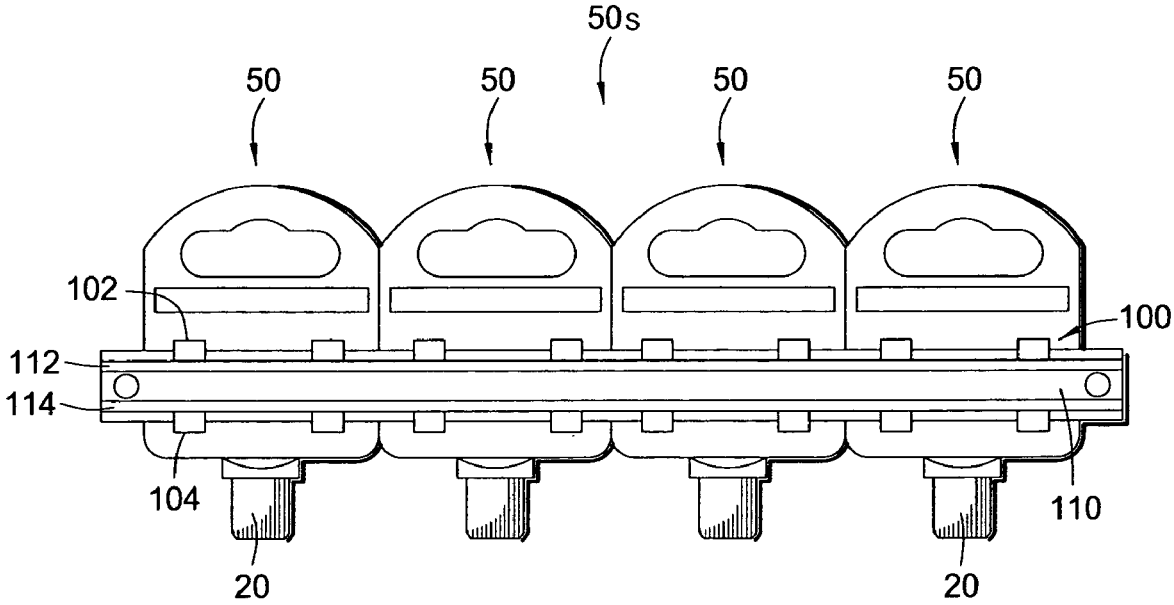
FIG. 5 shows a plurality of hangtags having been attached through the hangtag attachment apparatus of FIGS. 2 and 4. The hangtags are seen from a rear, elevational view. Four connected hangtags are seen. No tools are attached to the hangtags.

In accordance with the present invention, multiple hangtags 50 may be selectively attached to form a tool set. To this end, each hangtag 50 is provided with brackets 100 for receiving an attachment bar 110. FIG. 5 shows a plurality of hangtags 50 having been attached through the hangtag attachment apparatus 100/110 of FIGS. 2 and 4. The hangtags 50 are seen from a rear, elevational view. Four connected hangtags 50 are seen. No tools are attached to the hangtags 50. Nevertheless, it is understood that various tools may be attached to the tool attachment mechanisms 20 on each hangtag 50.

Each hangtag 50 has a substantially identical bracket arrangement 100. The brackets 100 receive the same elongated attachment bar 110. The attachment bar 110 is of sufficient length to travel through the brackets 100 of at least two and preferably at least three hangtags 50. In this way, a set 50*s* of hangtags is provided. The attachment bar 110 is fabricated from a material of sufficient strength as to rigidly support the hangtags 50, allowing the hangtags to be displayed on a display panel together as a set 50*s*.

Figure 6:
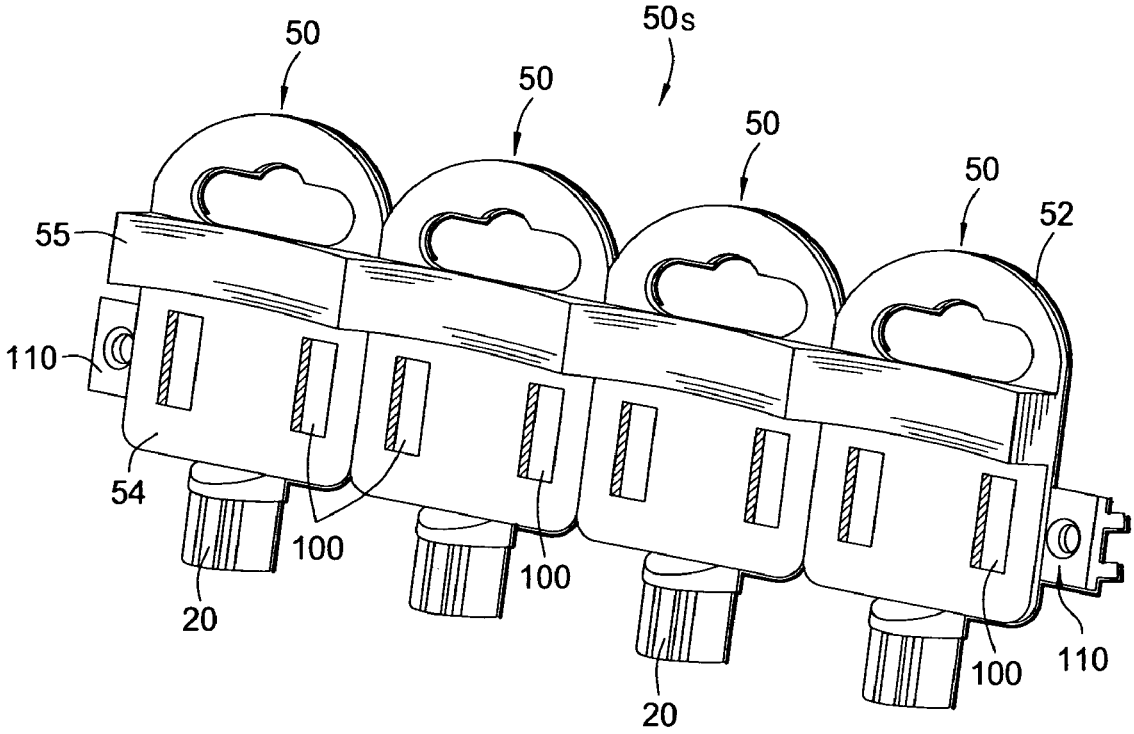
FIG. 6 presents a front, perspective view of the four connected hangtags of FIG. 5. End portions of the attachment bar are visible.

FIG. 6 presents a front, perspective view of the four connected hangtags 50 of FIG. 5. The end portions of the attachment bar 110 are visible extending past the set 50*s* of hangtags 50. By connecting the multiple hangtags 50 with the attachment bar 110, a true set 50*s* of hangtags 50 with attached tools (not shown) can be sold.

A hangtag attachment apparatus 52 is typically provided with each hangtag 50. When multiple hangtags 50 are attached using the hangtag attachment apparatus 100/110, the retailer has the option of using only a single hook to support the hangtag set 50*s*.

Figure 7:
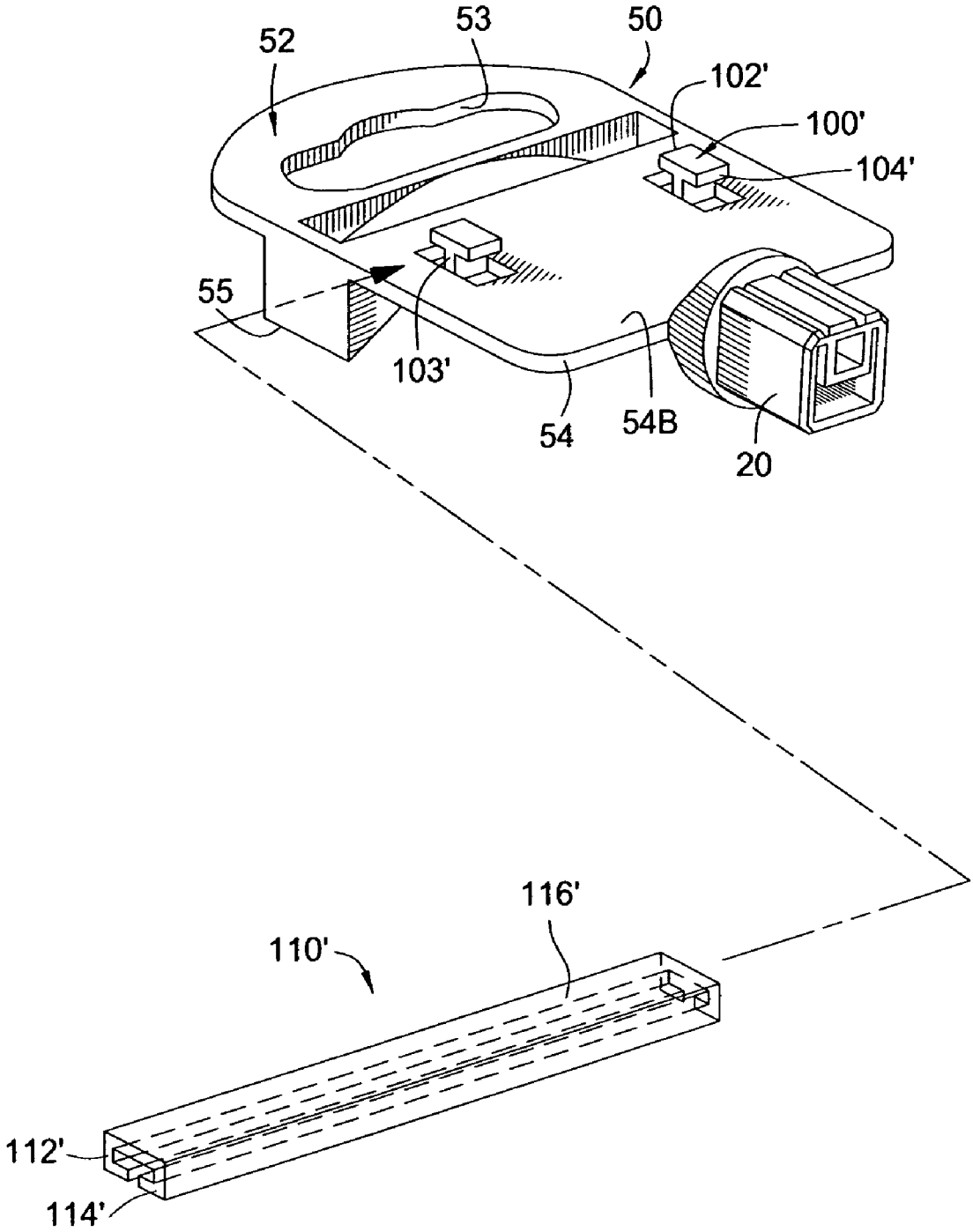
FIG. 7 provides a perspective rear view of a hangtag of the present invention, in an alternate embodiment. The back surface of the body portion of the hangtag is again visible. The back surface includes an alternate bracket for receiving an alternate elongated attachment bar. The mating attachment bar is seen exploded away from the hangtag.

FIG. 7 provides a perspective of a hangtag 50, having an alternate embodiment for the hangtag attachment apparatus 100/110. The back surface 54*b* of the body portion 54 of the hangtag 50 is again visible. The back surface 54*b* includes an alternate bracket 100' for receiving an alternate elongated attachment bar 110'. The mating attachment bar 110' is seen exploded away from the hangtag 50.

As in the arrangement of FIG. 2, the bracket 100' is again comprised of upper 102' and lower 104' shoulder members. However, in this alternate arrangement, the shoulders 102', 104' extend in opposite directions from a common pedestal 103'. The bracket 100' is again configured to receive the mating attachment bar 110'. The mating attachment bar 110' is seen exploded away from the hangtag 50 in FIG. 7. Together, the bracket 100' and the attachment bar 110' form an alternate hangtag attachment apparatus 100/110.

Figure 8:
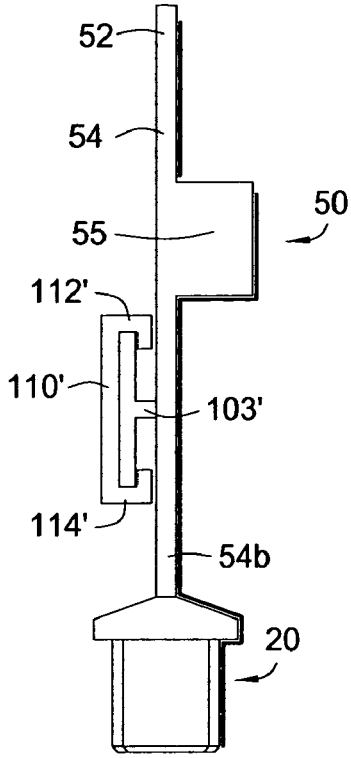
FIG. 8 presents the hangtag of FIG. 7 in a side view. The attachment bar is shown mated with the bracket to form a hangtag attachment apparatus.

As noted, FIG. 7 shows the alternate attachment bar 110' exploded away from the hangtag 50. Underside portions of the attachment bar 110' are seen in phantom. The attachment bar 110' defines an elongated bar dimensioned to be received around brackets 100' of at least two hangtags 50. In the arrangement of FIGS. 7 and 8, the attachment bar 110' is substantially planar. However, any geometry may be used so long as the attachment bar 110' can be fixedly received around the brackets 100' of the hangtags 50.

It can be seen in FIG. 7 that the alternate attachment bar 110' has upper 112' and lower 114' guide rails. The guide rails 112' and 114' are supported on a base 116'. Together, the guide rails 112' and 114' and the base 116' are dimensioned to ride on the bracket 100'. In the arrangement of FIG. 7, the guide rails 112', 114' and the base 116' cover the upper 102' and lower 104' shoulder members of the bracket 100'.

FIG. 8 presents the hangtag 50 of FIG. 7 in a side view. The attachment bar 110' is shown disposed around the bracket 100' on the back surface 54*b* of the hangtag 50. In this manner, the alternate hangtag attachment apparatus 100'/110' is formed.

As with the hangtag 50 of FIG. 2, the hangtag 50 of FIG. 7 has a tool supporting mechanism 20 attached to the body portion 54. The tool supporting mechanism 20 serves to support a tool, such as the socket 10 in FIG. 1. It is again understood that the present invention is not limited by the type of tool supporting mechanism 20 used, or the type of tool attached to the hangtag 50.

Figure 9:
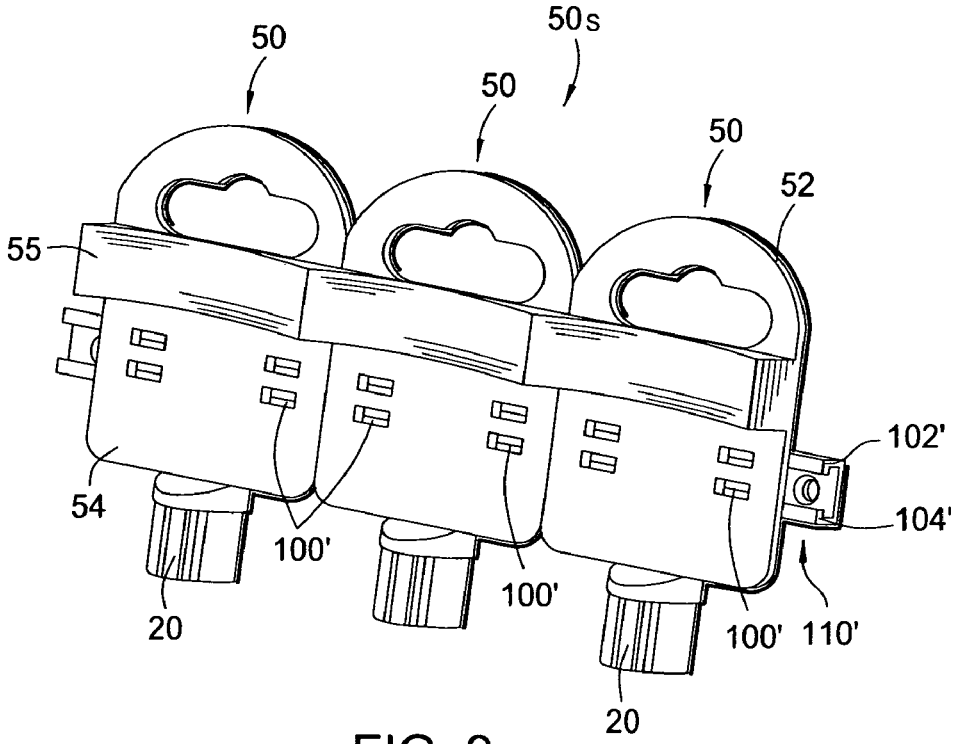
FIG. 9 shows a plurality of hangtags having been attached through the hangtag attachment apparatus of FIG. 7. The hangtags are seen from a front, perspective view. Three connected hangtags are seen.

As noted above, the benefit of the hangtag arrangement the present invention is that multiple hangtags 50 may be selectively attached to form a tool set. To this end, each hangtag 50 is provided with brackets 100' for receiving an attachment bar 110'. FIG. 9 shows a plurality of hangtags 50 having been attached through the alternate hangtag attachment apparatus 100'/110' of FIG. 7. The hangtags 50 are seen from a front, perspective view. Three connected hangtags 50 are seen. No tools are attached to the hangtags 50. Nevertheless, it is understood that various tools may be attached to the tool attachment mechanisms 20 on each hangtag 50.

Each hangtag 50 has a substantially identical bracket arrangement 100'. The brackets 100' receive the same elongated attachment bar 110'. The attachment bar 110' is of sufficient length to travel through the brackets 100' of at least two and preferably at least three hangtags 50. In this way, a set 50*s* of hangtags is provided. The attachment bar 110' is fabricated from a material of sufficient strength as to rigidly support the hangtags 50, allowing the hangtags to be displayed on a display panel together as a set 50*s*.

Figure 10:
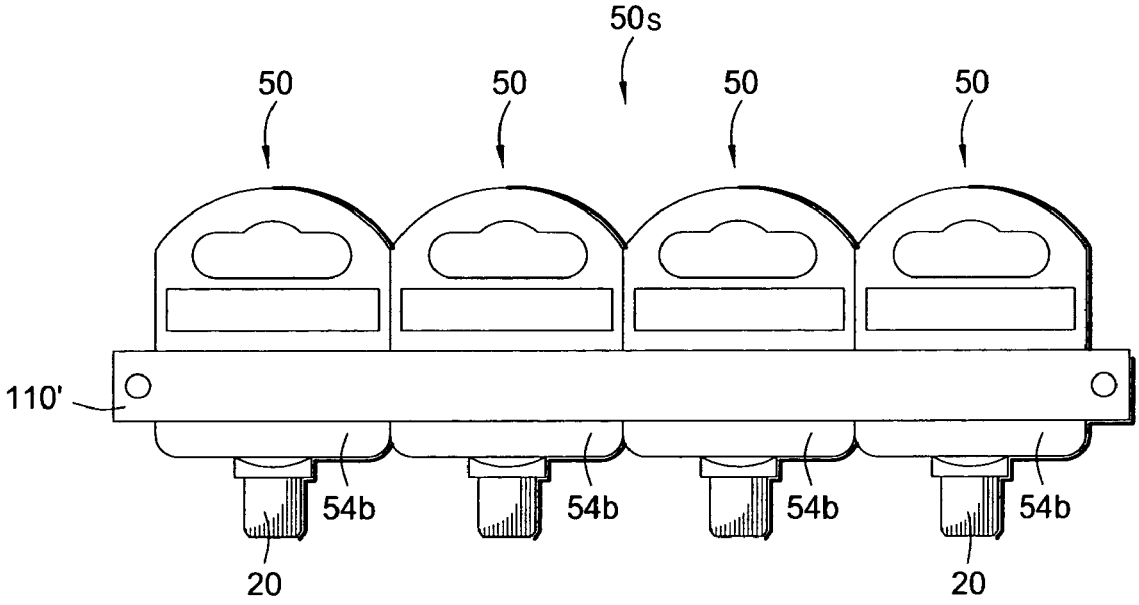
FIG. 10 presents a rear, elevational view of the three connected hangtags of FIG. 9. No tools are attached to the hangtags.

FIG. 10 presents a rear, elevational view of the three connected hangtags 50 of FIG. 9. The end portions of the attachment bar 110' are visible extending past the set 50*s* of hangtags 50. By connecting the multiple hangtags 50 with the attachment bar 110', a true set 50*s* of hangtags 50 with attached tools (not shown) can be sold.

A hangtag attachment apparatus 52 is typically provided with each hangtag 50. When multiple hangtags 50 are attached using the alternate hangtag attachment apparatus 100'/110', the retailer has the option of using only a single hook to support the hangtag set 50*s*.

While the foregoing is directed to embodiments of the present invention, other and further embodiments of the invention may be devised without departing from the basic scope thereof, and the scope thereof is determined by the claims that follow.

The invention claimed is:

1. hangtag for hanging a tool, the hangtag comprising:

a body portion having a front surface and a back surface;

a hanging mechanism connected to the body portion;

a tool supporting mechanism also connected to the body portion for supporting a tool;

a bracket disposed on the back surface of the body portion, wherein the bracket comprises an upper shoulder and a lower shoulder; and an elongated attachment bar configured and dimensioned to be selectively attached to and detached from the bracket of the hangtag, so that one or more separate hangtags may be selectively attached, wherein the attachment bar comprises a base, an at least one upper guide rail and at least one lower guide rail, the at least one guide rail being received within the upper and lower shoulders of the bracket.

2. The hangtag of claim 1 wherein: the attachment bar is dimensioned to have a length sufficient to connect the hangtag to at least two separate hangtags.

3. A hangtag attachment apparatus for connecting multiple hangtags, each hangtag comprising a body portion having a front surface and a back surface, a hanging mechanism connected to the body portion, and a tool supporting mechanism also connected to the body portion for supporting a tool, the hangtag attachment apparatus comprising:

a bracket disposed on the back surface of the body portion of the hangtag, wherein the bracket comprises an upper shoulder and a lower shoulder; and an elongated attachment bar configured and dimensioned to be selectively attached to and detached from the bracket of the hangtag, so that multiple hangtags may be selectively connected together, wherein the bar comprises a base, an upper guide rail, and a lower guide rail, wherein at least one guide rail being received within the upper and lower shoulders of the bracket.

4. The hangtag attachment apparatus of claim 3, wherein: the attachment bar is dimensioned to have a length sufficient to connect at least three hangtags together.

5. A hangtag for hanging a tool, the hangtag comprising:

a body portion having a front surface and a back surface;

a hanging mechanism connected to the body portion;

a tool supporting mechanism also connected to the body portion for supporting a tool;

a bracket disposed on the back surface of the body portion, wherein the bracket comprises an upper shoulder and a lower shoulder; and an elongated attachment bar configured and dimensioned to be selectively attached to and detached from the bracket of the hangtag, so that one or more separate hangtags may be selectively attached, wherein the attachment bar comprises a base and at least one upper guide rail, and at least one lower guide rail that cover the bracket, the base and the at least one guide rail being configured to ride on the bracket.

6. The hangtag of claim 5, wherein: the attachment bar is dimensioned to have a length sufficient to connect at least three hangtags together.

7. A hangtag attachment apparatus for connecting multiple hangtags, each hangtag comprising a body portion having a front surface and a back surface, a hanging mechanism connected to the body portion, and a tool supporting mechanism also connected to the body portion for supporting a tool, the hangtag attachment apparatus comprising:

a bracket disposed on the back surface of the body portion of the hangtag, wherein the bracket comprises an upper shoulder and a lower shoulder; and an elongated attachment bar configured and dimensioned to be selectively attached to and detached from the bracket of the hangtag, so that multiple hangtags may be selectively connected together, wherein the bar comprises a base, an upper guide rail and a lower guide rail wherein at least one guide rail being received within the upper and lower shoulders of the bracket.

8. The hangtag attachment apparatus of claim 7, wherein: the attachment bar is dimensioned to have a length sufficient to connect at least three hangtags together.

* * * * *